US009150971B2

(12) United States Patent
Zeng et al.

(10) Patent No.: US 9,150,971 B2
(45) Date of Patent: Oct. 6, 2015

(54) AEROBIC OXIDATION OF ALKANES

(75) Inventors: Xiangqun Zeng, Rochester Hills, MI (US); Zhe Wang, Auburn Hills, MI (US)

(73) Assignee: Oakland University, Rochester, MI (US)

( * ) Notice: Subject to any disclaimer, the term of this patent is extended or adjusted under 35 U.S.C. 154(b) by 256 days.

(21) Appl. No.: 13/597,071

(22) Filed: Aug. 28, 2012

(65) Prior Publication Data

US 2014/0061058 A1 Mar. 6, 2014

(51) Int. Cl.

| | |
|---|---|
| ***C07C 27/10*** | (2006.01) |
| ***C07C 29/10*** | (2006.01) |
| ***C07C 35/00*** | (2006.01) |
| ***C07C 29/00*** | (2006.01) |
| ***C07C 31/00*** | (2006.01) |
| ***C07C 31/02*** | (2006.01) |
| ***C07C 33/00*** | (2006.01) |
| ***C07C 27/00*** | (2006.01) |
| ***C25B 3/02*** | (2006.01) |
| ***C25B 3/00*** | (2006.01) |
| ***C25B 9/08*** | (2006.01) |

(52) U.S. Cl.

CPC ... *C25B 3/02* (2013.01); *C25B 3/00* (2013.01); *C25B 9/08* (2013.01)

(58) Field of Classification Search

None

See application file for complete search history.

(56) References Cited

U.S. PATENT DOCUMENTS

| | | | | |
|---|---|---|---|---|
| 3,069,352 | A * | 12/1962 | Mosesman | 208/140 |
| 4,801,574 | A * | 1/1989 | Brown et al. | 502/342 |
| 2012/0029245 | A1 | 2/2012 | Corradini et al. | |

OTHER PUBLICATIONS

Sen, A. "Homogeneous Palladium (II) Mediated Oxidation of Methane", Platinum Metals Rev. 1991, 35, (3), 126-132.*

(Continued)

*Primary Examiner* — Clinton Brooks

(74) *Attorney, Agent, or Firm* — Dierker & Associates, P.C.

(57) ABSTRACT

An aerobic method for oxidizing an alkane is disclosed herein. At least a portion of a surface of a platinum working electrode is activated at an interface between the platinum working electrode and an ionic liquid electrolyte (i.e., 1-ethyl-1-methylpyrrolidinium bis(trifluoromethylsulfonyl) imide, 1-propyl-1-methylpyrrolidinium bis(trifluoromethylsulfonyl)imide, 1-butyl-1-methylpyrrolidinium bis(trifluoromethylsulfonyl)imide, 1-pentyl-1-methylpyrrolidinium bis(trifluoromethylsulfonyl)imide, 1-hexyl-1-methylpyrrolidinium bis(trifluoromethylsulfonyl)imide, 1-heptyl-1-methylpyrrolidinium bis(trifluoromethylsulfonyl)imide, 1-octyl-1-methylpyrrolidinium bis(trifluoromethylsulfonyl)imide, 1-nonyl-1-methylpyrrolidinium bis(trifluoromethylsulfonyl) imide, and 1-decyl-1-methylpyrrolidinium bis(trifluoromethylsulfonyl)imidem, and combinations thereof). An interface complex is formed at the interface. An alkane gas is supplied to the interface. The alkane adsorbs at or near the interface complex. The alkane gas in the presence of oxygen is supplied to the interface. While the alkane gas in the presence of oxygen is supplied to the interface, a positive electrode potential is applied to the platinum working electrode, which causes a reactive oxygen species formed at the interface to catalyze oxidation of the adsorbed alkane to form a reaction product.

20 Claims, 9 Drawing Sheets

(56) References Cited

OTHER PUBLICATIONS

Zhdanov et al. "Simulation of Methane Oxidation on Pt", Journal of Chemical Physics 126, (2007), pp. 234705-1-234705-6.
Rosen et al. "Ionic Liquid-Mediated Selective Conversion of CO2 to CO at Low Overpotentials", Science, vol. 334, Nov. 4, 2011, pp. 643-644 (supporting materials 13 pages).
Bernskoetter et al. "Characterization of a Rhodium(I)δ-Methane Complex in Solution", Science, vol. 326, Oct. 23, 2009, pp, 553-556.
Periana et al. "Catalytic, Oxidative Condensation of CH4 to CH3COOH in One Step Via CH Activation", Science, vol. 301, Aug. 8, 2003, pp. 814-818.
Shu, et al. "An Fe2(IV)O2 Diamond Core Structure for the Key Intermediate Q of Methane Monooxygenase", Science, vol. 275, Jan. 24, 1997, pp. 515-518.
Ermler et al. "Crystal Structure of Methyl-Coenzyme M Reductase: The Key Enzyme of Biological Methane Formation", Science, vol. 278, Nov. 21, 1997, pp. 1457-1462.
Himes et al. "A New Copper-Oxo Player in Methane Oxidation", PNAS, Nov. 10, 2009, vol. 106, No. 45, pp. 18877-18878.
Sobota, Toward Ion.-Liq.-Based Mod. Cat.:Growth,Orient.,Conf. & Int. Mech.of the [Tf2N] An. on [BMIM][Tf2N] Thn Flms on a Well-Ord.Alum.Surf.,Langmuir 2010,26(10) 7199-7207.
Burch et al. "Kinetics and Mechanism of the Reduction of NO by C3H8 over Pt/Al2O3 under Lean-Burn Conditions", J. of Catalysis 169, (1997), pp. 45-54.
Zhdanov et al. "Simulation of the Kinetics of Oxidation of Saturated Hydrocarbons on Pt", J. of Catalysis 195, (2000), pp. 46-50.
Vayenas et al. "Dependence of Catalytic Rates on Catalyst Work Function", Letters to Nature, vol. 343, Feb. 15, 1990, pp. 625-627.

* cited by examiner

[$C_4$ mpy] [$NTf_2$]

AEROBIC OXIDATION OF ALKANES

STATEMENT REGARDING FEDERALLY SPONSORED RESEARCH OR DEVELOPMENT

This invention was made with government support under Grant No. 1R21OH009099-01A1 by the National Institute for Occupational Safety and Health (NIOSH). The government has certain rights in the invention.

BACKGROUND

Methane is the main constituent of natural gas. In nature, methane oxidizes to methanol at room temperature via methane monooxygenase enzymes that have iron-oxygen or copper-oxygen sites. The electrochemical oxidation of methane is thermodynamically favored, and thus attempts have been made to reproduce the reactivity of methane monooxygenase enzymes using a variety of electrochemical techniques. The direct oxidation of methane at low temperatures (e.g., from about 60° C. to about 150° C.) has been demonstrated with electrode systems utilizing acid electrolytes or polyelectrolytes. However, these systems exhibit extremely slow electrode kinetics at room temperature. The replication of the efficiency of nature's enzymatic oxidation of methane has proven to be challenging and difficult, especially using electrochemistry.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
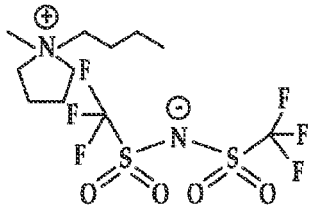
FIG. 1 is the structural formula of 1-butyl-1-methylpyrrolidinium bis(trifluoromethylsulfonyl)imide.

The present disclosure relates generally to the aerobic oxidation of alkanes. Examples of the method disclosed herein involve the electrochemical promotion of alkane oxidation at an interface between a platinum electrode and an ionic liquid electrolyte (i.e., an organic salt that is a liquid at room temperature). In particular, the method(s) utilize alkyl substituted methylpyrrolidinium bis(trifluoromethylsulfonyl)imide ionic liquid electrolytes, or $[C_nmpy][NTf_2]$ (where n=2-10). Examples of these ionic liquids include 1-ethyl-1-methylpyrrolidinium bis(trifluoromethylsulfonyl)imide (i.e., $C_2mpy][NTf_2]$), 1-propyl-1-methylpyrrolidinium bis(trifluoromethylsulfonyl)imide (i.e., $C_3mpy][NTf_2]$), 1-butyl-1-methylpyrrolidinium bis(trifluoromethylsulfonyl)imide (i.e., $C_4mpy][NTf_2]$), 1-pentyl-1-methylpyrrolidinium bis(trifluoromethylsulfonyl)imide (i.e., $C_5mpy][NTf_2]$), 1-hexyl-1-methylpyrrolidinium bis(trifluoromethylsulfonyl)imide (i.e., $C_6mpy][NTf_2]$), 1-heptyl-1-methylpyrrolidinium bis(trifluoromethylsulfonyl)imide (i.e., $C_7mpy][NTf_2]$), 1-octyl-1-methylpyrrolidinium bis(trifluoromethylsulfonyl)imide (i.e., $C_8mpy][NTf_2]$), 1-nonyl-1-methylpyrrolidinium bis(trifluoromethylsulfonyl)imide (i.e., $C_9mpy][NTf_2]$), and 1-decyl-1-methylpyrrolidinium bis(trifluoromethylsulfonyl)imide (i.e., $C_{10}mpy][NTf_2]$), and combinations thereof. $[C_4mpy][NTf_2]$ is shown in FIG. 1. It is to be understood that the other ionic liquids have similar structures, except the butyl group is replaced with another alkane.

It is believed that the loosely-packed double layer formed in $[C_4mpy][NTf_2]$ and the other ionic liquids disclosed herein allows for facile alkane adsorption and subsequent alkane oxidation at the interface between the platinum electrode and ionic liquid. The double layer of the ionic liquid is formed by the arrangement of ion pairs at the electrode/electrolyte interface, which depends upon the electrode potential. Generally, the bulky ions of ionic liquids allow the formation of a much more flexible and less compact double layer, when compared to double layers formed in aqueous electrolytes. The double layer formed in the ionic liquids disclosed herein is particularly suitable for allowing small gas molecules to pass through to and to reach the electrode/electrolyte interface.

The method(s) disclosed herein may advantageously be achieved at room temperature (i.e., at a temperature ranging from about 18° C. to about 30° C.). It is believed, however, that the method(s) disclosed herein may be performed in any temperature up to 200° C., based, at least in part, upon the thermal stability of the ionic liquid used. Performing the method at or near room temperature may be particularly desirable, for example, for electrocatalysis applications, for harnessing methane for energy storage, conversion or synthesis, for making methane-based fuel cells, and/or for developing methane sensors (e.g., for monitoring methane in mining, domestic gas supplies, etc.). As such, it is believed that the method(s) disclosed herein may be used in a variety of applications.

Figure 2A:
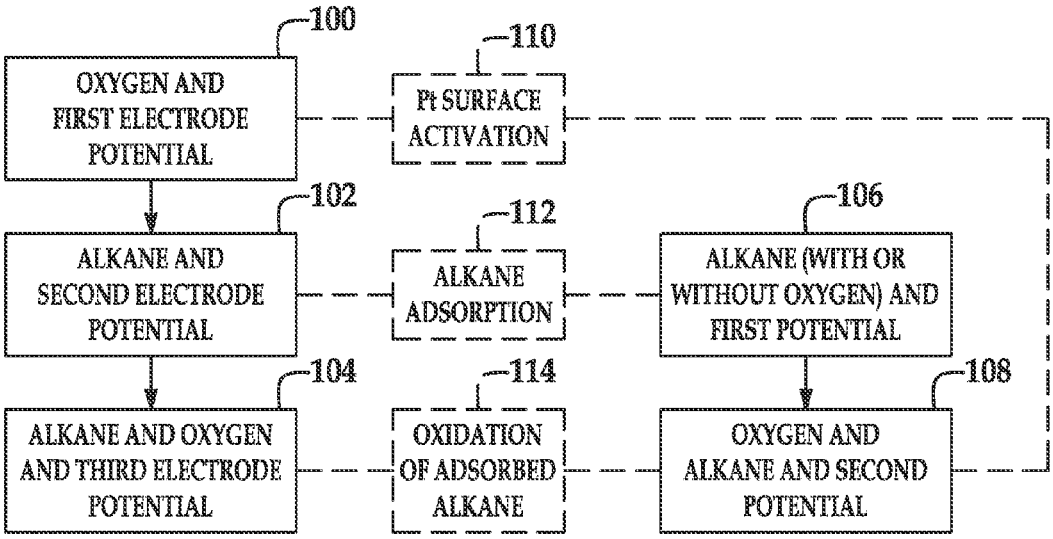
FIG. 2A is a flow diagram illustrating two examples of an alkane oxidation method, where the chemical process resulting from a particular step is shown linked to that step in broken line.

Referring now to FIG. 2A, two examples of the method are generally shown in solid line boxes. One of the methods includes reference numerals 100, 102 and 104, and another of the methods includes references numerals 106 and 108. The broken line boxes (reference numerals 110, 112, and 114) that are connected to one or more of the solid line boxes represent the chemical process that is believed to take place at the method step described in the connected solid line box(es). Each of the methods shown in FIG. 2A will be generally described, and then a more detailed description of one example of method will be described in reference to FIG. 2B.

An example of a three-step method includes steps 100, 102, and 104. At the outset, an interface between the ionic liquid and the platinum working electrode is exposed to an activation process. As shown at reference numeral 100, the activation process includes exposing the interface to oxygen (either pure oxygen or an oxygen-containing gas) and a first electrode potential (which is positive), which oxidizes at least a portion of the platinum working electrode surface. While not shown in FIG. 2A, it is to be understood that activation further includes exposing the interface to a reduction process (where the oxygen is removed and a more negative potential is applied). Two or more cycles of oxidation and reduction may be performed. It is believed that these steps result in the activation of the surface of the platinum working electrode (reference numeral 110). As will be described further below, platinum surface activation involves the formation of an interface complex on the surface and, in some instances, also involves the formation of a reactive oxygen species at the surface. The oxidation and reduction processes allow the platinum surface to be reconstructed and activated to form the interface complex or the interface complex and the reactive oxygen species.

This example of the method then moves to step 102, which includes exposing the interface to an alkane (in the absence of oxygen) and applying, to the platinum working electrode, a second electrode potential that is more negative than the first electrode potential. This step may also be performed without the application of the second electrode potential (i.e., no potential is applied or an open circuit potential is applied). It is believed that this step results in the adsorption of the alkane at or near the interface complex (reference numeral 112). In general, the alkane adsorption may be facilitated by applying potential or no potential based on an optimum alkane adsorption potential window.

Finally, this example of the method includes step 104, which involves exposing the interface to the alkane and to oxygen and applying, to the platinum working electrode, a third electrode potential that is more positive than both the first and second electrode potentials. As shown at reference numeral 114 in FIG. 2A, it is believed that this step 104 results in the oxidation of the adsorbed alkane.

An example of a two-step method includes steps 106 and 108. In this example, alkane adsorption (reference numeral 112) occurs when the alkane is exposed to the interface of the platinum working electrode and the ionic liquid electrolyte, and when a first potential is applied. In this example, the first potential may be less than about 0.6 V. In many instances, the first potential in this example method is a negative potential. The exposure of the alkane to the interface at step 106 may occur in the presence of oxygen or in the absence of oxygen. As shown at step 108, the interface is then exposed to the alkane and oxygen at a second potential that is more positive than the first potential. As shown at reference numerals 110 and 114, it is believed that this step 108 results in the platinum surface activation and the oxidation of the adsorbed alkane. The second potential in step 108 may be increased, and platinum surface activation may occur at a lower potential than alkane oxidation.

In each of the example methods, it is to be understood that the surface activation may be performed in the presence of some alkanes (e.g., methane), but should be performed in the absence of other alkanes (e.g., pentane and hexane). This may be due to the fact that some alkanes (e.g., pentane and hexane) are more readily oxidizable than other alkanes (e.g., methane). As an example, if platinum surface activation is performed in the presence of pentane or hexane, multiple undesirable products (e.g., soluble non-gas product(s) that may contaminate the system) may be formed. As such, the method shown at reference numerals 106 and 108 may not be suitable for easily oxidizable alkanes, such as pentane and hexane, because platinum surface activation takes place while the surface is exposed to the alkane. This process may be suitable for methane, at least in part because even if it is oxidized at this point, the products can be purged from the system. For the easily oxidizable alkanes, the method shown at reference numerals 100, 102, and 104 may be more desirable because the platinum activation process is performed in oxygen conditions without the presence of the alkane.

Figure 2B:
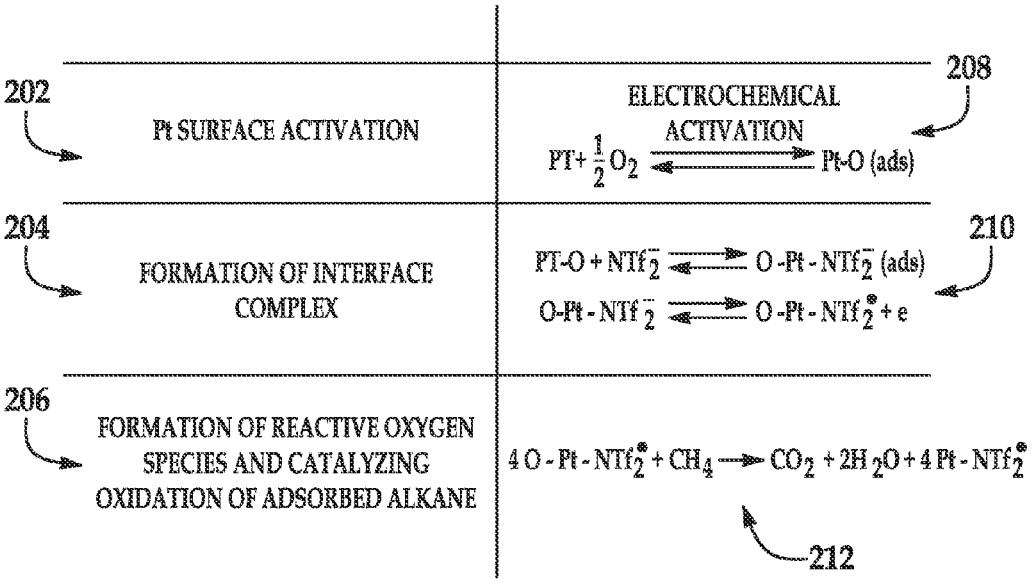
FIG. 2B is a table illustrating a flow diagram of an example of a methane oxidation method and the proposed chemical reaction mechanism that takes place at the various steps of the methane oxidation method.

Referring now to FIG. 2B, an example of the chemical processes occurring during an alkane oxidation method is schematically depicted on the left hand side of the figure, and the proposed chemical mechanism for methane oxidation is depicted on the right hand side of the figure. It is believed that the method shown in FIGS. 2A and 2B may be used for a variety of alkanes, including methane, pentane, hexane, or any other alkane. However, as noted above, examples of the method that perform platinum surface activation in the absence of the alkane are suitable for those alkanes that are more readily oxidizable. When liquid alkanes (e.g., pentane or hexane) are utilized, it is to be understood that a gas feeding system may be utilized to purge the vapors in order to perform the method. Furthermore, the reaction product(s) may vary depending upon the alkane that is selected.

In general and as outlined in FIG. 2A, the methods disclosed herein involve the activation of the platinum working electrode that is exposed to the ionic liquid (i.e., $[C_n mpy][NTf_2]$), the adsorption of the alkane at or near the activated electrode, and the subsequent oxidation of the adsorbed alkane. As will be discussed further herein, it is believed that the electrode activation, the alkane adsorption, and the subsequent alkane oxidation take place at different applied potentials. In some instances, alkane adsorption may even take place without any applied potential. As such, any suitable technique involving changing electrode interface potentials may be utilized. As examples, cyclic voltammetry, chronoamperometry, or any other techniques involving a potential sweep or step may be utilized.

Figure 3:
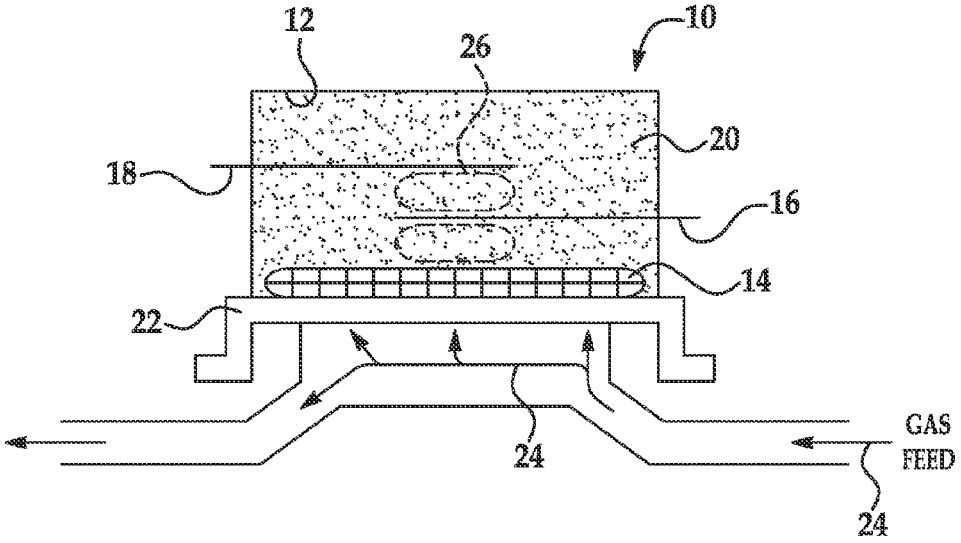
FIG. 3 is a schematic illustration of an electrochemical sensor that may be used to perform an example of the alkane oxidation method disclosed herein.

Referring briefly to FIG. 3, an example of a system 10 that may be used to perform the method(s) is schematically depicted. The system 10 may include a cell 12 that contains the electrodes (i.e., the platinum working electrode 14, a reference or quasi-reference electrode 16, and a counter electrode 18) and the ionic liquid 20 in contact with each of the electrodes 14, 16, 18. Examples of suitable reference and counter electrodes 16, 18 include polycrystalline platinum wires. An example of the platinum working electrode 14 is a mesh platinum gauze. This type of electrode 14 allows for efficient current collection with excellent gas diffusivity. A traditional sputtered platinum or platinum black electrode may not be suitable for the method or system (e.g., a reusable electrode) disclosed herein, at least in part because it can be deactivated in the presence of oxygen (i.e., platinum black has a tendency to strongly adsorb $CO_2$ which can deactivate the platinum surface). As such, a platinum black electrode may be more suitable for use as a limited-lifetime electrode that operates according to the method(s) disclosed herein.

The electrodes 14, 16, 18 may be separated by a porous cellulose spacer 26.

In the example shown in FIG. 3, the platinum working electrode 14 is pressed onto a porous gas-permeable membrane 22 which physically separates the interior of the cell 12 from a gas feed 24. In an example, the porous gas-permeable membrane 22 is polytetrafluoroethylene (an example of which is TEFLON® from Dupont).

One or more gases are fed through the gas feed 24. The gases permeate through the porous gas-permeable membrane 22 into the 12 where they participate in the various steps of the method(s) disclosed herein.

Referring back to FIG. 2B, as shown at reference numerals 202 and 204, the method generally begins with the activation of the surface of the platinum working electrode 14. As shown in FIG. 2A, this process may occur alone (step 100 in FIG. 2A), or it may occur as alkane oxidation occurs (step 108 in FIG. 2A). The activation of the platinum working electrode surface involves the oxidation and reduction of at least a portion of the platinum working electrode surface. The oxidation of the platinum working electrode surface may be accomplished by supplying oxygen molecules from the gas phase (e.g., from an oxygen-containing gas or from pure oxygen gas, either of which may be supplied alone or in combination with an alkane-containing gas) to the platinum working electrode surface while applying a positive electrode potential to the platinum working electrode 14. Examples of the oxygen containing gas include air, pure oxygen gas, or a mixture of oxygen gas and nitrogen gas (where $N_2$ is utilized as a diluting gas). Examples of the positive electrode potential that may be applied range from about 0.6 V vs. the quasi-reference electrode to about 1.0 V vs. the quasi-reference electrode. It is to be understood that the positive electrode potential may vary depending upon the reference electrode used. In an example for platinum surface activation, air is the oxygen-containing gas and the positive electrode potential is about 0.7 V.

During the oxidation of the surface of the platinum working electrode 14, the oxygen molecules from the gas phase adsorb on vacant sites of the platinum via irreversible dissociative adsorption. This is shown at reference numeral 208 in FIG. 2B. The oxygen molecules adsorbed on the platinum surface are shown as Pt—O (ads) in FIG. 2B; however, it is to be understood that the oxygen is not forming a covalent bond with the platinum, but rather, a platinum oxygen adsorbate is forming. It is believed that the oxygen atoms are not covalently bonded to the platinum, but rather are capable of diffusing in and between the atomic layers of the platinum working electrode 14 via jumps to vacant sites, which results in the reconstruction of the platinum surface.

Subsequent reduction of the platinum working electrode surface in the presence of the ionic liquid may facilitate the formation of an ionic liquid interface complex, as shown in FIG. 2B at reference numeral 210. Multiple cycles of oxidation and reduction may be performed in order to generate the ionic liquid-platinum interface complex that is activated throughout the process.

As mentioned above, the activation of the platinum working electrode 14 also involves the formation of the interface complex (see reference numerals 204 and 210). The oxidation of the platinum working electrode surface takes place in the presence of the $[C_n mpy][NTf_2]$ ionic liquid 20. It is believed that the $NTf_2^-$ anion from the ionic liquid 20 is capable of adsorbing on the oxidized platinum working electrode surface (Pt—O) and forming the interface complex (i.e., O—Pt—$NTf_2$., see reference numeral 210), which has high catalytic activity. By "high catalytic activity", it is meant that the interface complex is capable of interacting with the subsequently supplied alkane.

The bulk of the tetrahedral quaternary ammonium cations $[C_n mpy]^+$ of the $[C_n mpy][NTf_2]$ ionic liquid 20 can force the $NTf_2^-$ anions away from the cations. Furthermore, the delocalization of the negative charge along the —S—N—S— core of the $NTf_2^-$ anions also reduces the cation/anion interaction. It is believed that these properties of the $[C_n mpy][NTf_2]$ ionic liquid 20 aid in the formation of the interface complex (i.e., O—Pt—$NTf_2$.. It is also believed that the properties of the $[C_n mpy]^+$ cations keep the cations from strongly adsorbing on the activated platinum working electrode surface, and thus the cations do not interfere with the adsorption of the subsequently supplied alkane.

The oxygen in the interface complex (O—Pt—$NTf_2$.) may be considered a reactive oxygen species, which is formed during platinum surface activation and/or during alkane oxidation. In general, it is believed that the reactive oxygen species in the interface complex forms i) after the interface complex is formed, ii) when a positive electrode potential is applied to the platinum working electrode 14, and iii) when the interface is exposed to at least oxygen. The reactive oxygen species is believed to be formed as a result of the oxygen in the O—Pt—$NTf_2$. structure jumping to other vacant sites in the surface. It is also believed that the adsorption of the $NTf_2^-$ anions aids in the formation of the interface complex with the reactive oxygen species for further oxidation of alkane(s).

It is to be understood that all of the reactions shown at reference numerals 208, 210, and 212 are believed to take place at the surface of the platinum working electrode 14.

While not shown in FIG. 2B, the method includes supplying an alkane gas in the presence of oxygen to the interface between the $[C_n mpy][NTf_2]$ ionic liquid 20 and the activated surface of the platinum working electrode 14. The supplied gas may be, as examples, methane gas in the presence of an oxygen-containing gas, or pentane vapors in the presence of an oxygen-containing gas, or hexane vapors in the presence of an oxygen-containing gas, or any other alkane gas/vapor in the presence of an oxygen-containing gas. When a combination of the alkane gas and the oxygen-containing gas is utilized, the ratio of alkane gas to oxygen-containing gas may range anywhere from 1% alkane gas: 99% pure oxygen gas to 90% alkane gas: 10% pure oxygen gas. When air is utilized as the oxygen-containing gas, air contains about 20% oxygen. In these instances, the percentage of air utilized may vary depending on the desired amount of oxygen to be supplied.

The alkane that is supplied to the interface in the presence of oxygen adsorbs at or near the interface complex at the surface of the activated platinum working electrode 14. The alkane may adsorb on top of the interface complex and/or on the platinum electrode surface near the interface complex. Adsorption of the alkane may be more favorable when no potential is applied or when a particular potential is applied to the working electrode. As such, during alkane adsorption, the application of a potential and the value of any applied potential may vary depending upon the properties of the alkane being used.

In some instances, no potential is applied while the alkane gas (either alone or in combination with the oxygen-containing gas) is supplied to the interface. In these instances, an open circuit potential may be used. In this example, physical adsorption of the methane or other alkane occurs.

A suitable potential may be applied that assists in facilitating alkane adsorption. For example, a negative potential or a potential that is more negative than the other applied potential(s) is applied to the platinum working electrode 14 while the alkane gas (either alone or in combination with the oxygen-containing gas) is supplied to the interface. As noted above, the more negative potential that is applied may depend upon the type and the concentration of the alkane gas that is supplied. In an example, the more negative potential ranges anywhere from −1.0 V to 0.6 V. In other examples, the more negative potential which facilitates adsorption of the alkane may range anywhere from −0.5 V to about −0.2 V, or from −0.3 V or −0.5 V to about 0.6 V, from −1.0 V to 0 V. For methane adsorption, the desirable potential ranges from about −0.3 V to about 0.5 V. It is believed that the more negative potential facilitates methane adsorption and also conditions the platinum electrode to lead the alkane toward the surface. Other potentials may be selected that facilitate the adsorption of other alkanes.

When a potential is applied while the alkane gas is supplied to the interface, the optimum potential for alkane adsorption may be obtained, for example, by cyclic voltammetry.

While alkane adsorption may take place in the presence of the oxygen-containing gas (e.g., as shown at reference numeral 106 in FIG. 2A), it is to be understood that alkane adsorption may also take place in the absence of the oxygen-containing gas. As such, some examples of the method disclosed herein include a step of supplying the alkane gas to the interface in the absence of oxygen while simultaneously applying no electrode potential or the negative electrode potential (depending upon the alkane being used) to the platinum working electrode 14. This step may be performed, for example, during a first cycle of the method in order to initiate the absorption of the alkane at or near the interface complex (e.g., step 102 in FIG. 2A). In this example, during subsequent cycles, the mixture of the alkane gas and the oxygen-containing gas may be supplied to the interface to introduce additional alkanes.

After alkane adsorption takes place, a positive electrode potential may be applied to the platinum working electrode 14 while the alkane gas in the presence of the oxygen-containing gas is supplied to the interface. This is believed to initiate oxidation of the adsorbed alkanes. In an example, this positive electrode potential is generally more positive than the positive electrode potential applied during platinum working electrode surface activation. For example, in the method shown at steps 100, 102, and 104 of FIG. 2A, the surface activation potential may be at about 0.6 V to about 0.7 V, while the alkane oxidation potential may be higher than 0.7 V. In another example, a single positive electrode potential is applied in order to achieve both platinum surface activation and alkane adsorption. In this example, a single positive potential may be applied (after some alkane adsorption has taken place) that is positive enough to initiate both the oxidation step of platinum surface activation and alkane oxidation. In an example, the positive electrode potential applied in the single step is about 0.9 V.

As noted above, during the application of the positive electrode potential (step 104 or step 108 of the methods shown in FIG. 2A), oxidation of the adsorbed alkane takes place (see reference numeral 114 in FIGS. 2A and 206 in FIG. 2B). It is believed that the reactive oxygen species catalyzes the alkane oxidation. Upon application of the positive electrode potential, it is believed that an oxygen containing platinum adsorbate forms and bonds with ionic liquid anions (i.e., $NTf_2^-$). This adsorbate can be further oxidized to form the interface complex at the interface, which contains the reactive oxygen species at the surface of the platinum working electrode 14. The interface complex on the platinum surface then reacts with the alkane to break the C—H bonds and form suitable reaction products. When the alkane is methane, the reaction between the methane and the interface complex results in the formation of carbon dioxide and water (reference numeral 212 in FIG. 2B). Reference numeral 212 illustrates the overall reaction for alkane oxidation.

The positive electrode potential applied to initiate oxidation of the adsorbed alkane may depend upon the alkane used.

The reaction products may be removed from the system 10, or may remain in the system 10 during subsequent cycles. For example, the carbon dioxide reaction product may be removed from the system 10. Carbon dioxide removal may be accomplished via purging using dry air. Carbon dioxide may accumulate at the platinum working electrode surface, and thus may reduce or even prevent further alkane adsorption. As such, continuously removing the carbon dioxide from the platinum working electrode surface contributes to the continued adsorption and oxidation of the supplied alkanes. The removal of carbon dioxide also inhibits any reaction between the additionally supplied alkane (e.g., methane) and the carbon dioxide. The water product, which separates from the hydrophobic ionic liquid, may also be removed from the system 10 by air flowing above the cell 12. Minimal (i.e., trace) amounts of water may remain in the system 10 as it is believed that these amounts do not change the methane oxidation process. It is believed that this is also due to the hydrophobicity of the $[C_4mpy][NTf_2]$ ionic liquid 20. While the oxidation of water in the $[C_4mpy][NTf_2]$ ionic liquid 20 is thermodynamically feasible, the process is kinetically slow and thus the reaction is expected to proceed between the interface complex (which contains the reactive oxygen species) and the adsorbed methane.

Any example of the method disclosed herein may also involve performing a platinum surface regeneration method. This may be desirable after multiple cycles of alkane oxidation have taken place in order to remove any undesirably adsorbed reaction products from the platinum working electrode surface. The platinum surface regeneration method removes any oxide film from the platinum surface and freshly activates the platinum surface. The regeneration may be performed within the potential window in which the ionic liquid is stable (i.e., the potential window within which the ionic liquid itself cannot be oxidized (positive potential limit) and reduced (negative potential limit)). As such, the conditions of the regeneration method are dependent, at least in part, on the ionic liquid used. For platinum working electrode surface regeneration when $[C_4mpy][NTf_2]$ is used as the ionic liquid, a positive electrode potential of about 2.5 V may be applied under air flow for a time sufficient (e.g., for about 2 minutes) to replace adsorbed reaction products with a Pt—O layer. These conditions enable relatively quick platinum oxidation. The Pt—O layer may then be treated at a negative electrode potential of about −2.5 V under nitrogen gas flow for a time sufficient (e.g., for about 3 minutes) to reduce the oxygen and remove reduction products out of the system 10. This process may also remove moisture from the system. The $[C_4mpy][NTf_2]$ ionic liquid 20 is stable over a wide potential range, and thus regeneration of the platinum working electrode surface may take place in a reasonable time (e.g., at about 5 minutes). After platinum surface regeneration, the process may be repeated in order to reactivate the platinum working electrode surface and to oxidize alkanes supplied thereto.

In one example of the method, the alkane gas and the oxygen-containing gas are supplied simultaneously in order to achieve activation, adsorption, and oxidation. In this example, different potentials are applied to first achieve the platinum working electrode surface activation, the alkane adsorption, and then the alkane oxidation. For example, surface activation may take place at about 0.7 V, alkane (e.g., methane) adsorption may take place at about −0.3 V, while alkane (e.g., methane) oxidation takes place at about 0.9 V. Each of these potential is for methane oxidation using the $[C_4mpy][NTf_2]$ ionic liquid. The potentials may be different, for example, if a different ionic liquid and/or a different alkane is used.

In ionic liquid electrolytes, the previously mentioned unique double layer is formed that has three structurally distinct regions: an interfacial (innermost) layer composed of ions in direct contact with the electrode; a transition region over which the pronounced interfacial layer structure decays to the bulk morphology; and a bulk liquid region where structure depends on the degree of ion amphiphilicity. Slow scan rates may result in the reorientation of the ionic liquid. It is believed that this deleterious effect may be by-passed using high scan rates (i.e., 500 mV/s). As such, higher scan rates minimize the hysteresis of the ionic liquid double layer. It is further believed that this scan rate provides a balance between signals ($i_{ps}/i_{dl}$), where $i_{ps}$ is the peak current resulting from the faradic process (i.e., the process of the species involving electron transfer) and $i_{dl}$ is the double layer charging current. The higher the $i_{ps}/i_{dl}$ ratio, the better the sensitivity for sensor application, as the double layer charging current is not analyte specific and may be considered to be a noise signal.

Furthermore, multiple cycles may be used to condition the electrode-ionic liquid interface to reach a steady state of the ionic liquid electrode double layer.

It is to be understood that in the methods disclosed herein, the actual potentials applied may vary, at least in part, on the concentration of the alkane gas and/or oxygen-containing gas that is/are supplied to the system 10. Furthermore, the potentials disclosed herein are versus a quasi-reference electrode, and it is to be understood that the potentials may be shifted if another reference electrode is utilized.

To further illustrate the present disclosure, examples are given herein. It is to be understood that these examples are provided for illustrative purposes and are not to be construed as limiting the scope of the disclosed example(s).

EXAMPLES

The ionic liquid(s) (i.e., 1-butyl-1-methylpyrrolidinium bis(trifluoromethylsulfonyl)imide ($[C_4mpy][NTf_2]$) and/or 1-butyl-3-methylimidazolium bis(trifluoromethylsulfonyl) imide ($[C_4mim][NTf_2]$) used in the Examples disclosed herein were prepared by standard literature procedures.

In the following Examples, a system similar to that shown in FIG. 3 was used, in part, to show that the methane oxidation reaction is specific. The working electrode was a 100-mesh Pt gauze (with an area of 0.64 $cm^2$) and the reference and counter electrodes were 0.5-mm Pt wires (Sigma-Aldrich, St. Louis, Mo.). High purity (99.99%) gases (i.e., air, nitrogen, methane, carbon dioxide, $NO_2$, NO, and $SO_2$) from Airgas Great Lakes (Independence, Ohio) were used. In Example 2, pentane and hexane liquids were used, and a gas feeding system was used to purge pentane or hexane vapors and feed them into the system 10 shown in FIG. 3.

The Examples were carried out at a temperature of 25±1° C., and the relative humidity was varies from 10%-90%.

In the Examples, the total gas flow was controlled at 200 sccm by digital mass-flow controllers (MKS Instruments Inc). Any mixed gases were made by pre-mixing various gases in a glass bottle with a stirring fan before introducing them in the testing system. Humidified gas streams were achieved by directing nitrogen gas at a desirable flow rate through a Dreschel bottle (250 mL) partially filled with water prior to mixing with the gas analytes.

The characterization of the electrochemical methane sensor used in Example 1 was performed with a VersasStatMC (Princeton AMETEK US). The uncompensated resistance of the electrochemical cell containing each ionic liquid was measured and is reported in Table 1 below. All potentials for the characterization were referenced to the platinum quasi reference electrode potential.

TABLE 1

| Ionic Liquid | η (at 25° C.) mPs s | Λ S $m^{-1}$ | d g $cm^{-3}$ | $V_m$ $cm^3$ $mol^{-1}$ | Ru Ω | Potential Window V |
|---|---|---|---|---|---|---|
| $([C_4mpy][NTf_2])$ | 76, 56 | 0.29 | 1.41 | 317 | 18.36 | −3.0 to +3.0 |
| $([C_4mim][NTf_2])$ | 49, 45 | 0.39 | 1.42 | 295 | 14.59 | −2.0 to +2.7 |

η is the viscosity;

Λ is the conductivity;

d is the mass density (±1%).

$V_m$ is the molar volume (±1%).

Ru is the uncompensated resistance of this cell which was collected by electrochemical impedance measurements.

The oxygen redox potential for each ionic liquid was calibrated using a ferrocene probe. The oxygen redox process in the pure ionic that had been calibrated with a ferrocene redox process in the same ionic liquid was used for the calibration of the redox potential throughout Example 1. In the absence of impurities, it was found that the reactive oxygen species was stable and reversible in ionic liquid solvents. The use of the reduction of oxygen as a potential calibration in an ionic liquid system may be beneficial since oxygen can be easily and removed and the concern that trace additives, such as ferrocene, may change the properties of the ionic liquid is moot.

In Example 1, infrared spectroelectrochemical characterization was also performed. For this characterization, working ($8\times8$ $mm^2$) and reference ($8\times1.5$ $mm^2$) platinum electrodes were sputtered to a thickness of 200 nm on a glass slide. The counter electrode in this system was a Pt wire. A thin layer, about 1 mm thick, of the respective $[C_4mpy][NTf_2]$ ionic liquid or the $[C_4mim][NTf_2]$ comparative ionic liquid was added on the electrode surfaces. A 1.5 mm height Viton barrier surrounding the cell was pressed on the glass slide to contain the respective ionic liquids. Before testing, the whole system was placed in the FTIR chamber with dry air flow for about 3 hours and in situ IR spectra were obtained in the reflectance mode with p-type polarized IR light. Spectra of the Pt electrode without ionic liquid under dry air were collected as background and all other FTIR measurements (i.e., those with the respective ionic liquids, those with the respective ionic liquid and methane, and those with the respective ionic liquid and various methane/air mixtures during applied potential) were subtracted from this background IR spectra. Varian Excalibur series 3100 FTIR spectrometer with a liquid nitrogen-cooled MCT detector was used to obtain all IR spectra.

Example 1

Oxidation of Methane

Figure 4A:
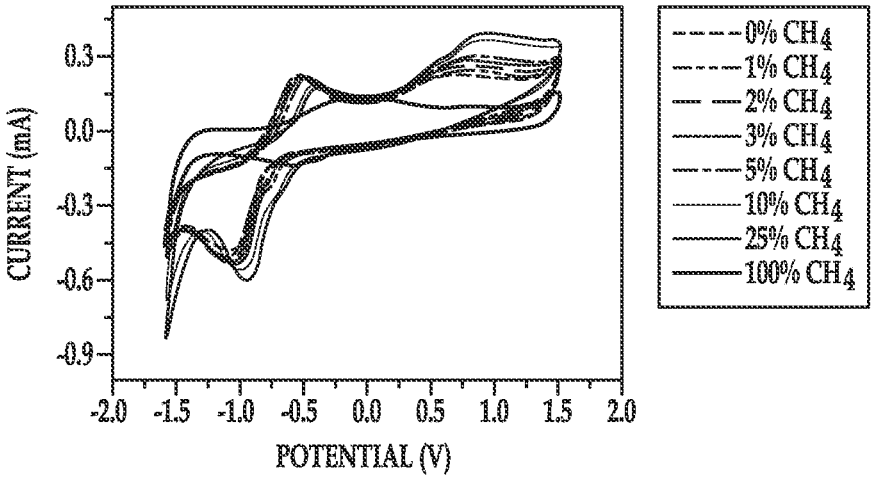
FIGS. 4A and 4B are cyclic voltammograms of different methane concentrations supplied to a system including, respectively, 1-butyl-1-methylpyrrolidinium bis(trifluoromethylsulfonyl)imide as the ionic liquid electrolyte and 1-butyl-3-methylimidazolium bis(trifluoromethylsulfonyl)imide as the comparative ionic liquid electrolyte.
Figure 4B:
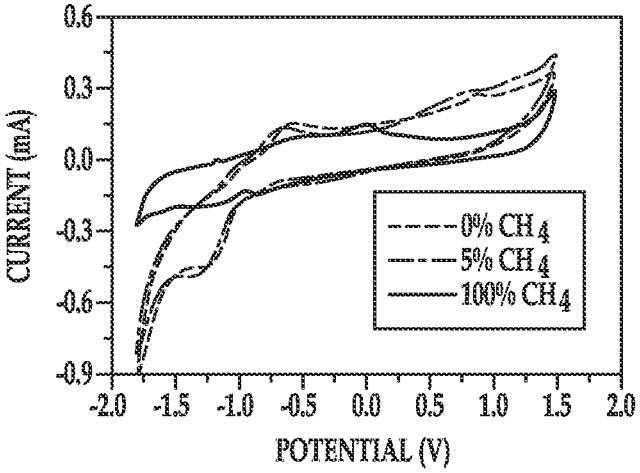

The system including the $[C_4mpy][NTf_2]$ ionic liquid and the system including the $[C_4mim][NTf_2]$ comparative ionic liquid were exposed to cyclic voltammetry in air (i.e., 0% methane), in methane (i.e., 100% methane, no air), and in one or more mixtures of air and methane. The scan rate was 500 $mVs^{-1}$, and the results in FIGS. 4A and 4B are the results of the $6^{th}$ scanning cycle. FIG. 4A depicts the cyclic voltammograms for the system including the $[C_4mpy][NTf_2]$ ionic liquid and FIG. 4B depicts the cyclic voltammograms for the system including the $[C_4mim][NTf_2]$ comparative ionic liquid.

For both ionic liquids, oxygen reduction and superoxide oxidation peaks were observed at about −1.2 V and about −0.6 V, respectively. The oxygen reduction was relatively more reversible with higher currents in the $[C_4mpy][NTf_2]$ ionic liquid compared to that of the $[C_4mim][NTf_2]$ comparative ionic liquid. It was also observed that the double layer charging current in the $[C_4mpy][NTf_2]$ ionic liquid was slightly different from that of the $[C_4mim][NTf_2]$ comparative ionic liquid. It is believed that the differences in the double layer charging current were due to the stronger adsorption of the cation $[C_4mim]^+$ on the Pt surface than that of the cation $[C_4mpy]^+$.

When 100% air (0% methane) was supplied to the systems, a broad anodic peak was observed at ~0.7 V for the system with the $[C_4mpy][NTf_2]$ ionic liquid (FIG. 4A). This anodic peak was the result of oxidation of the platinum working electrode. The same anodic peak was much smaller for the system with the $[C_4mim][NTf_2]$ comparative ionic liquid (FIG. 4B). It is believed that the stronger adsorption of the planar and aromatic structure of $[C_4mim]^+$ on platinum can reduce the adsorption of oxygen on the platinum surface, and hinder both the oxygen reduction and the platinum oxidation processes.

Methane adsorption and desorption were observed for the system with the $[C_4mpy][NTf_2]$ ionic liquid. More particularly and as shown in FIG. 4A, when pure methane (i.e., 100% methane and no oxygen) was supplied to the system with the $[C_4mpy][NTf_2]$ ionic liquid, a broad anodic peak was observed at −0.25 V (indicative of methane adsorption) and a reversible broad cathodic peak was observed around −0.75 V (indicative of methane desorption). These methane adsorption/desorption peaks were not obvious in the system with the $[C_4mim][NTf_2]$ comparative ionic liquid.

For the system with the $[C_4mpy][NTf_2]$ ionic liquid, the oxidation of methane was observed as an anodic peak at about 0.9 V (FIG. 4A). With increasing methane concentration in the presence of oxygen, the anodic methane oxidation peak initially seen around ~0.9 V shifted slightly to a more positive electrode potential (again, see FIG. 4A). Methane concentrations as high as 90% were evaluated, however, the response was lower than the detection limit. This is indicative that relatively high levels (at or above 10%) of oxygen should be present for the oxidation of methane to occur. For the system with the $[C_4mim][NTf_2]$ comparative ionic liquid, little or no methane oxidation current was observed (FIG. 4B).

Figure 5A:
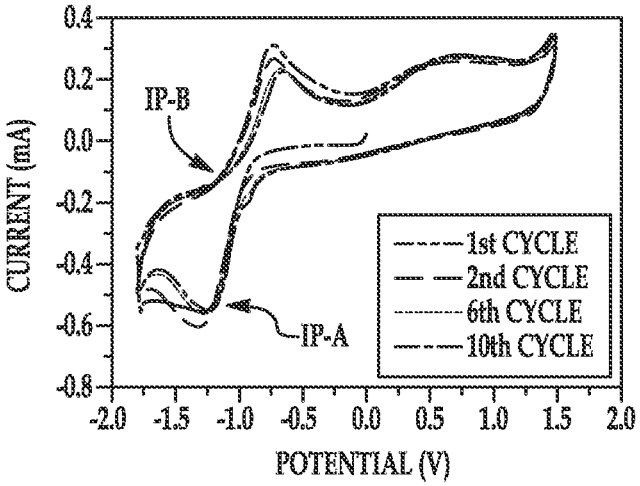
FIGS. 5A and 5B are cyclic voltammograms of, respectively, 5% methane (95% air) and 25% methane (75% air) supplied to the system including 1-butyl-1-methylpyrrolidinium bis(trifluoromethylsulfonyl)imide as the ionic liquid electrolyte.
Figure 5B:
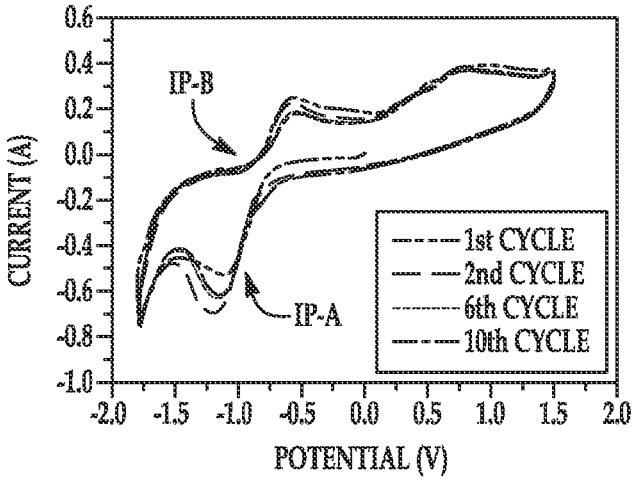

FIGS. 5A and 5B show the cyclic voltammograms obtained for the system including the $[C_4mpy][NTf_2]$ ionic liquid when exposed to 5% methane (95% air) and 25% methane (75% air). The data for the $1^{st}$, $2^{nd}$, $6^{th}$ and $10^{th}$ cycles are shown. In the $1^{st}$ cycle, the potential was conditioned at 0.0 V and scanned to a negative potential of −1.8 V. Then the potential was subsequently scanned between −1.8 V and 1.5 V.

In the first cathodic scan, a cathodic peak at −1.1 V was observed. It is believed that this was due to oxygen reduction and the formation of the superoxide radical (which was oxidized at −0.7 V during the subsequent anodic scan). A broad anodic peak at 0.5 V was due to the oxidation of platinum or the simultaneous oxidation of the adsorbed methane and the oxidation of platinum.

In the second and subsequent cathodic scan cycles, a new small cathodic peak was observed at −0.8 V. This new cathodic peak was attributed to the oxygen reduction in the presence of $H_2O$ or $CO_2$ (the reaction products). This peak manifested in the third scan cycle when methane was at 5 vol %, but it emerged at the second scan cycle when methane was at 25 vol %. It is believed that this was due to the fact that higher concentration methane could generate more $H_2O$ and $CO_2$ as products. This belief was further supported by the increasing peak current of the oxygen reduction peak at −1.1 V, and the decrease of the peak current of the superoxide oxidation peak in the second cycle and subsequent cycles. The increase in oxygen reduction current and the decrease in superoxide oxidation current are characteristic of a reaction in which $O_2$ is regenerated to produce the net effect of a two-electron irreversible reduction of $O_2$ in the presence of water and/or carbon dioxide. This reaction includes:

$$O_2+e\rightarrow O_2.^-$$

$$2CO_2+2O_2.^-\rightarrow 2C_2O_6^{2-}+O_2$$

$$H_2O+O_2.^-\rightarrow O_2+HOO^-+HO^-$$

During the continuous potential scanning, more water and carbon dioxide were produced and accumulated on the working electrode surface. It is believed that the change in peak currents and peak positions at various methane concentrations and scan cycles were the results of these effects.

The observation of isopotential points (IP-A, IP-B) in the multiple potential cycling experiments substantiated the surface processes believed to be occurring in the methane oxidation processes on the platinum electrode. An isopotential point occurs in a family of current-potential curves at an electrode provided that i) the potential scanning program is the same for all curves, ii) the electrode surface is partially covered with at least one adsorbed or deposited species at the start of the application of the potential program, iii) the initial amount of adsorbed or deposited species is different for each curve, and iv) the electrode surface behaves as if it consists of two independent electrochemical regions and the sum of whose areas is constant at all times for all of the current-potential curves.

As shown in FIGS. 5A and 5B, two isopotential points (IP-A, IP-B) were observed, respectively, in the cathodic and anodic scan in the oxygen reduction and superoxide oxidation potential windows. Since these isopotential points lie on the residual I-E curve, the oxidation of methane and/or the oxidation of the underlying platinum electrode surface is/are the process(es) giving rise to these points. It is believed that IP-A and IP-B involved the reduction of $O_2$ in the presence of methane oxidation products, carbon dioxide and water. It is believed that both oxygen and methane are absorbed on the electrode at different regions, and that during the anodic sweep, the simultaneous oxidation of adsorbed methane and underlying platinum will generate carbon dioxide and water. The water present at the electrode surface may participate in subsequent oxygen reduction processes. When the current density for all processes at one region of the electrode equals the current density for all processes on the other regions of the electrode, the isopotential points occur.

Figure 6:
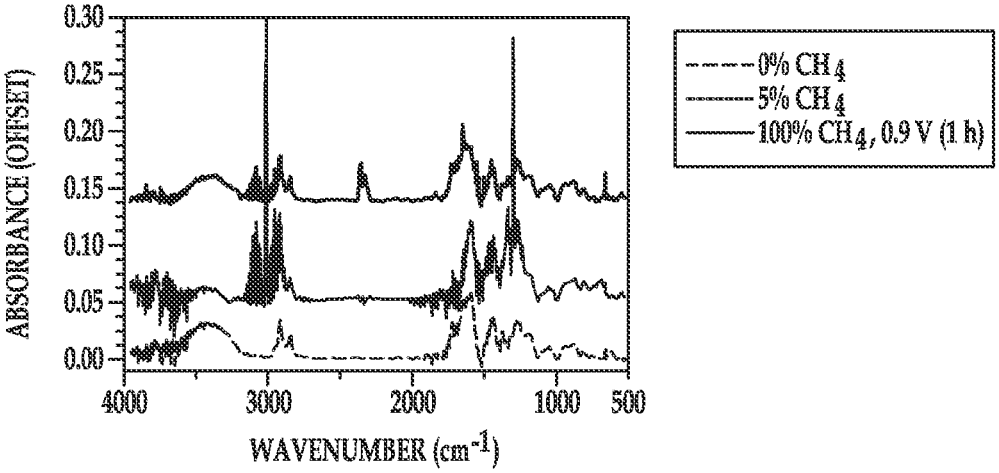
FIG. 6 is the in situ p-type polarized FTIR reflectance spectra observed when a $[C_4mpy][NTf_2]$/Pt interface was exposed to air, 5 vol. % methane in air with no applied potential, and 5 vol. % methane in air after oxidation at 0.9 V for 60 minutes.

In situ infrared spectroelectrochemical characterization (IR-SEC) was used to examine the $[C_4mpy][NTf_2]$/Pt interfaces under potential control with p-polarized IR. In situ IR-SEC is beneficial for studying IL/Pt interface since the organic nature of ILs allows the monitoring of the products or intermediates of reaction on the electrode surface as a function of applied potential without the interference from water and solvents encountered in most aqueous or non-aqueous systems. The in situ p-type polarized FTIR reflectance spectra were obtained when the $[C_4mpy][NTf_2]$/Pt interface was exposed to air, 5 vol. % methane in air with no applied potential, and 5 vol. % methane in air after oxidation at 0.9 V for 60 mins. These results are shown in FIG. 6. The exposure of the $[C_4mpy][NTf_2]$/Pt interface to air without applied potential was used as the background to correct all FTIR measurements in the presence of methane at the various potentials so that the peak due to $CO_2$ in air was subtracted and the amount of new products could be calculated.

As shown in FIG. 6 for 0% methane, the hydrogen bond vibration peak from water at 3400 $cm^{-1}$ was observed even though the air used was dry and the whole system was purged with dry air. This indicates that the trace absorbed water on the platinum surface during the system setup process was very difficult to remove using a dry air flow alone.

With 5% methane purging into the system, the water peak at 3400 $cm^{-1}$ decreased (FIG. 6). Henry's constant of methane in $[C_4mpy][NTf_2]$ is about 300 bar, which is much lower than 4000 bar of nitrogen at room temperature. The adsorption of methane in $[C_4mpy][NTf_2]$ can be observed around 3000 $cm^{-1}$. According to IR surface selection rule, only the adsorbate modes with a dipole moment component perpendicular to the reflecting surface can interact with the IR beam. Strong bands at 3000 $cm^{-1}$, 2900 $cm^{-1}$, and 1305 $cm^{-1}$ were observed in methane IR spectra. The band at 3000 $cm^{-1}$ was assigned to the $v_3$ mode (stretch). The band at 1305 $cm^{-1}$ was ascribed to the $v_1$ mode (deform) of the adsorbed methane. The band around 2900 $cm^{-1}$ arose from the $v_1$ (symmetric stretch). The appearance of an infrared forbidden vibration mode $v_1$ was a strong indication of methane adsorption.

When the potential of 0.9 V was applied for 60 minutes to the platinum working electrode while the 5% methane was purged into the system, the multiple peaks were reduced, compared with the results at open circuit in which no potential was applied to the electrode. This suggested that the product of methane oxidation (i.e., carbon dioxide and water) selectively adsorbed on a Pt site, which resulted in the depletion of the adsorbed methane. Methane electrooxidation at 0.9 V lead to the appearance of double IR peaks, which is consistent with a $CO_2$ peak at 2345 $cm^{-1}$ and a broad band water peak at 3400 $cm^{-1}$. There were no bands found around 2100 $cm^{-1}$. This observation suggested that molecular species, such as CO, COOH and CHO (i.e., the incomplete products of oxidation of a hydrocarbon, such as methane), observed in other systems were not present in the systems disclosed herein. The results also suggest that the only reaction products were carbon dioxide and water.

There were also no obvious peak shifts related to the ionic liquid, which implies that, during the methane oxidation, the double layer structure at the platinum electrode/ionic liquid interface remains intact.

Figure 7A:
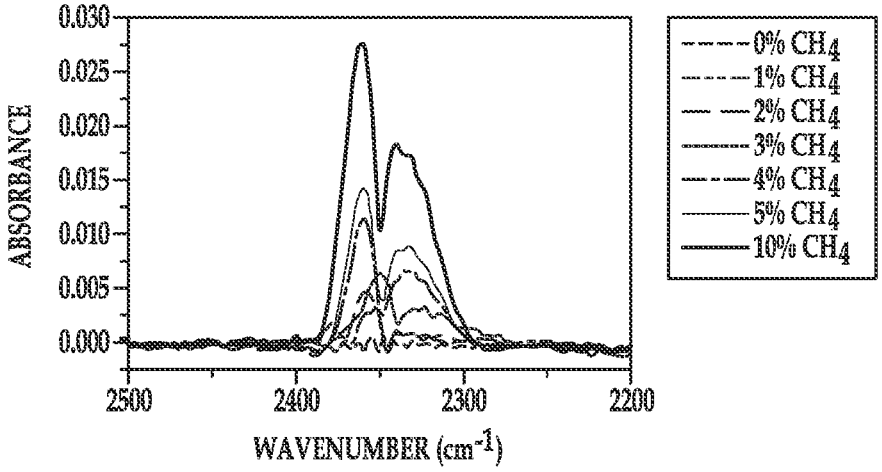
FIG. 7A is the in situ p-type polarized FTIR reflectance spectra observed when a $[C_4mpy][NTf_2]$/Pt interface was exposed to different methane concentrations in air after oxidation at 0.9 V.
Figure 7B:
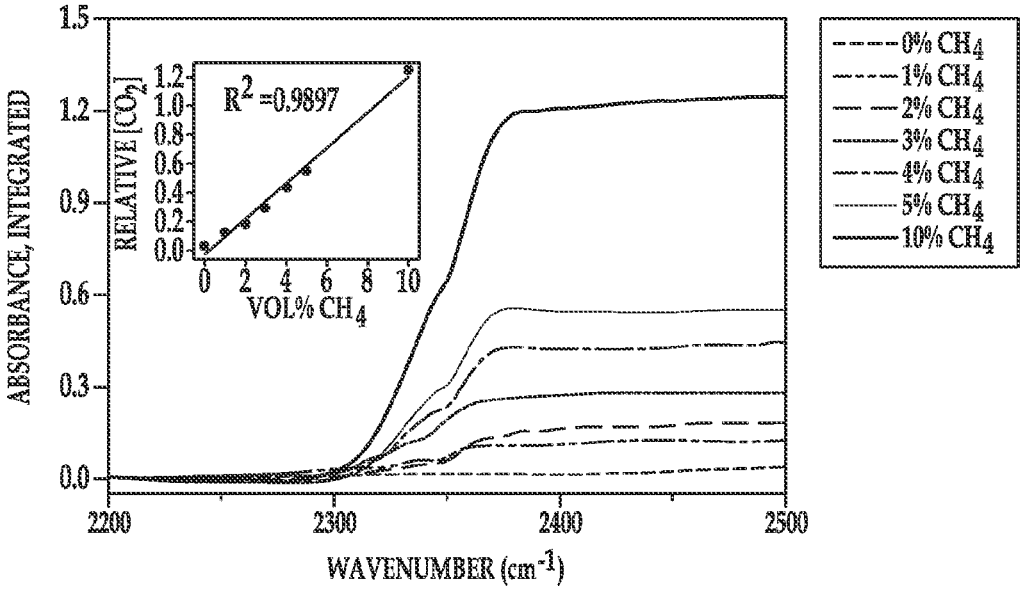
FIG. 7B is a graph depicting the integrated absorbance of the $CO_2$ peaks of FIG. 7A as a function of wavenumber at various methane concentrations, where the inset depicts the normalized $CO_2$ concentration versus the methane concentration.

FIG. 7A illustrates the results of in situ IR-SEC with different methane concentrations in air at 0.9 V. As illustrated, with increasing methane concentration methane, the $CO_2$ peak around 2345 $cm^{-1}$ increased. The peak area, which was related to $CO_2$ concentration, was integrated and plotted as a function of wavenumber at various methane concentrations, as shown in FIG. 7B. In order to calculate relative content, the 10% $CO_2$ concentration was normalized to unity and a linear relationship was obtained with methane concentration. This is shown at the inset of FIG. 7B.

The methane oxidations in the system with the $[C_4mpy][NTf_2]$ ionic liquid and the system with the $[C_4mim][NTf_2]$ comparative ionic liquid were further characterized using cyclic voltammetry.

Figure 8A:
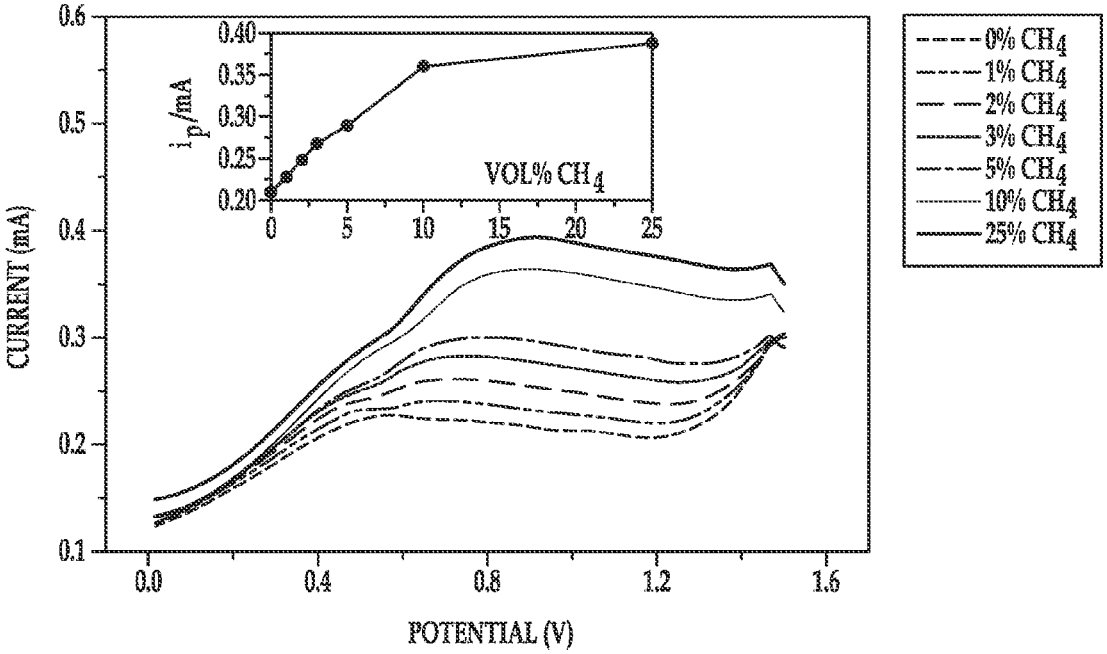
FIGS. 8A and 8B depict anodic current sweeps of different methane concentrations exposed to a system including, respectively, 1-butyl-1-methylpyrrolidinium bis(trifluoromethylsulfonyl)imide as the ionic liquid electrolyte and 1-butyl-3-methylimidazolium bis(trifluoromethylsulfonyl)imide as the comparative ionic liquid electrolyte, where the insets plot peak current at 0.9 V against vol % methane.

FIG. 8A depicts a series of cyclic voltammograms for the system with the $[C_4mpy][NTf_2]$ ionic liquid when exposed to different concentration methane-air mixtures. The broad peak around 0.9 V was due to the multi-step methane oxidation process disclosed herein. A linear relationship of peak currents vs. square root of scan rates confirmed the methane oxidation process disclosed herein can be considered a diffusion controlled process. As shown at the inset of FIG. 8A, the anodic peak current at ~0.9 V increased with methane concentration in a linear fashion, confirming that the response of voltammetry signal in $[C_4mpy][NTf_2]$ is primarily dependent on the concentration of methane available at the gas/IL electrolyte/Pt electrode three-phase boundary. As shown in FIG. 8A, the peak potential shifts slightly to more a positive potential at higher methane concentrations, which confirms that methane adsorption occurs first, followed by methane oxidation at the interface.

Figure 8B:
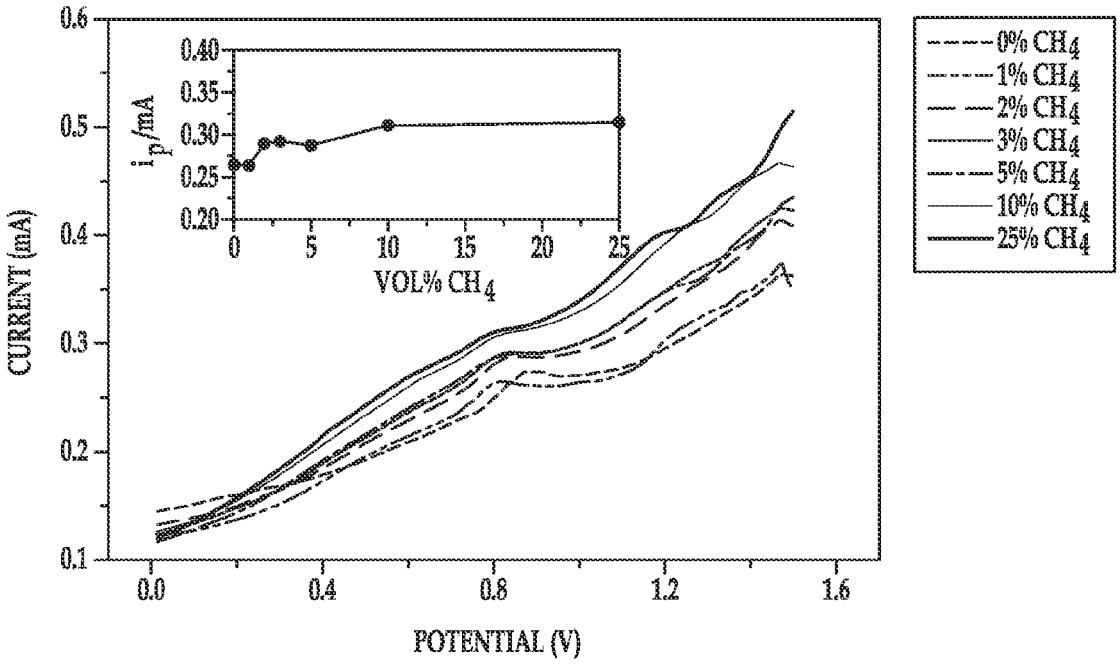

FIG. 8B depicts a series of cyclic voltammograms for the system with the $[C_4mim][NTf_2]$ ionic liquid when exposed to different concentration methane-air mixtures. As shown in FIG. 8B, the oxidation current for methane was very small in comparison with $[C_4mpy][NTf_2]$, and no linear relationship between methane concentrations and peak currents was obtained. This result supported the rationalization that the planar and aromatic structure of the cation $[C_4mim]^+$ can absorb on Pt surface at open circuit, which limits methane adsorption. The small peak located at 0.8 to 1.0 V in $[C_4mim][NTf_2]$ was related to the change in the double layer charging current due to rearrangement of the double layer structure when the potential was scanned in the anodic direction (i.e., the negative charged $[NTf_2]^-$ anion can replace the $[C_4mim]^+$ cation from the platinum electrode surface and form a new double layer structure). The strongly adsorbed $[C_4mim]^+$ cation prevented methane adsorption and this in turn inhibited the methane oxidation processes.

Referring back to FIG. 5A, these results illustrated that the difference of peak current of methane oxidation in the $1^{st}$ and $6^{th}$ cycles was less than 0.002 μA, which confirmed that the methane concentration profile in ionic liquid is the same in different cycles. Since the lower and upper explosive limits of methane in air are 5 vol % and 15 vol %, respectively, 1-25 vol % of methane concentration range was tested. Overall, the results show that at above 10% methane in air, the peak current changes as a result of the decrease in the oxygen concentration in the gas, and the complete methane combustion reaction in air requires a methane to oxygen mole ratio to be 1:2, in which 8 vol % of methane in air is the best concentration for this reaction. From 0-10% methane, the methane sensitivity was 13.7 μA/%, while the sensitivity dropped to 1.73 μA/% at high methane concentrations. The calibration curves for methane sensing are as follows:

$$I_{(0\text{-}10\%)}(A)=2.28\times10^{-4}+1.37\times10^{-5}\times C_{CH4}(\text{Vol. }\%)\quad (r^2=0.97)$$

$$I_{(10\%\text{-}25\%)}(A)=3.42\times10^{-4}+1.73\times10^{-6}\times C_{CH4}(\text{Vol }\%).$$

Based upon these results, the best sensitivity was achieved for methane oxidation taking place with a methane concentration ranging from about 1% to about 10%. Other percentages (e.g., up to 90% methane) do work well, but the sensitivity is generally lower since methane concentration is high and the reactions are dominated by oxygen concentration in air, not methane. As an example, suitable sensitivity may be achieved when the methane concentration is 25% or less.

Figure 9A:
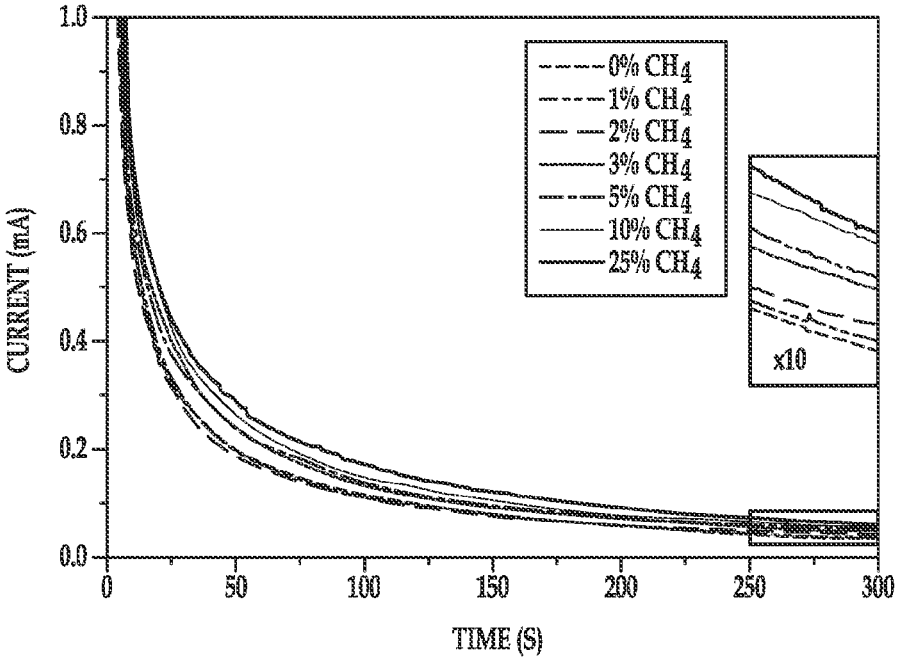
FIGS. 9A and 9B respectively illustrate chronoamperometry curves for methane oxidation and a methane calibration curve generated using the current after 300 seconds.

Chronoamperometry was also used to test the system with the $[C_4mpy][NTf_2]$ ionic liquid. FIG. 9A illustrates the chronoampermetry curve for methane oxidation. It is believed that the oxidation processes at the platinum electrode and ionic liquid interface play a prominent role in the activation of the interface complex.

For chronoampermetry, a multiple potential step method was applied to the system in the presence of methane or air. First, the platinum electrode was stepped from open circuit potential to a potential of −1.8 V for 300 seconds (to reduce the oxygen) and was then switched to 1.5 V for 300 seconds to oxidize the platinum electrode. These steps were performed to generate a clean platinum surface. These steps may also be performed using potential cycling. The potential was then stepped back to −1.8 V for 300 seconds in order to ensure an oxygen free platinum surface. During these three steps, the oxygen layer on the platinum surface was removed in the first step and an oxygen free platinum surface was exposed to $[C_4mpy][NTf_2]$. The platinum surface was re-oxidized by stepping the potential to a positive potential, which generated the catalyst (the interface complex including the reactive oxygen species) for methane oxidation at the electrode surface. Finally, the potential was stepped to 0.9 V (near the methane oxidation potential). It is to be understood that the generation of the interface complex with the reactive oxygen species and the methane oxidation could be performed in a single step by stepping the potential to 0.9 V.

The current vs. time curves in FIG. 9A at 0.9 V show multiple relaxation processes occurring at the $[C_4mpy][NTf_2]$/Pt interface. The current increased with increasing methane concentration. Two dynamic ranges with regards to sensitivity were observed: one is from 0-10% methane in air and the other was from 10%-25%. The sensitivity was 2.0 μA/% at concentrations lower than 10% volume methane concentration.

Figure 9B:
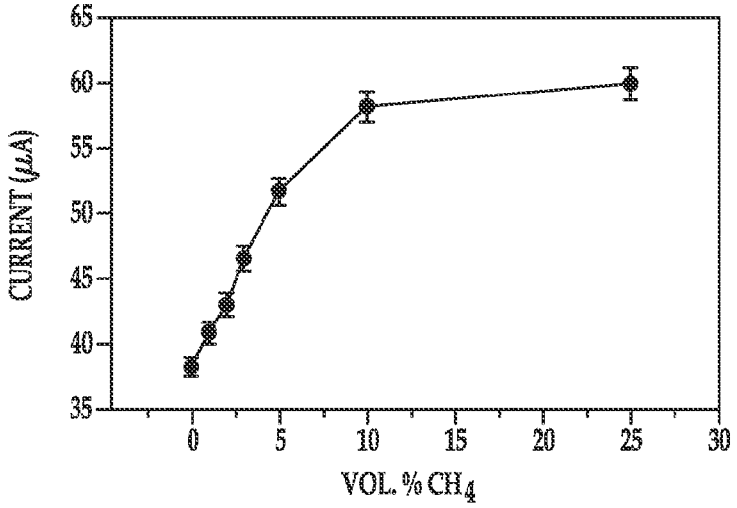

FIG. 9B illustrates the methane calibration curve generated using the current after 300 second. The relationship between methane concentration and current at $300^{th}$ second is:

$$I_{(0\text{-}10\%)}(A)=3.93\times10^{-5}+2.01\times10^{-6}\times C_{CH4}\quad (\text{Vol. }\%)\ (r^2=0.96)$$

$$I_{(10\text{-}25\%)}(A)=5.70\times10^{-4}+1.15\times10^{-7}\times C_{CH4}(\text{Vol }\%).$$

Figure 10:
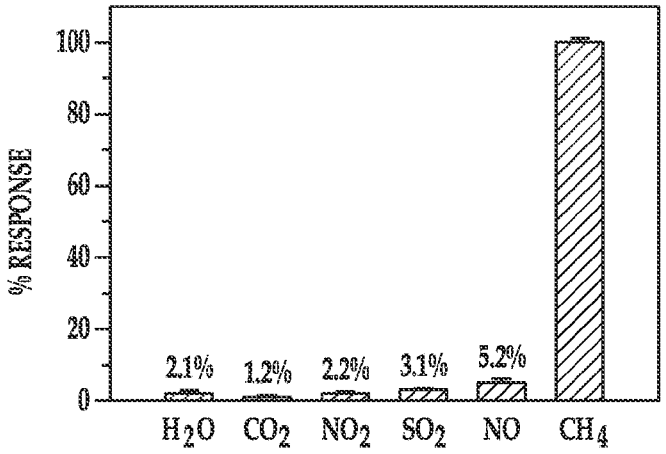
FIG. 10 is a graph depicting the peak current response of the system including 1-butyl-1-methylpyrrolidinium bis(trifluoromethylsulfonyl)imide as the ionic liquid electrolyte to non-target gases and methane (i.e., the target gas) at 1.0 vol % in air based on a potential step method, where the number appearing over each bar denotes the selectivity coefficient for methane over a given gas, based on the respective peak current ($i_p$) ratio (where the selectivity coefficient=$i_p$'(1% non-target gas)/$i_p$(1% methane gas), and where the peak current ($i_p$) of 1% methane is defined as 100% response)

The system with the $[C_4mpy][NTf_2]$ ionic liquid was shown to be highly selective to methane. FIG. 10 is a graph illustrating the percent response of the system with the $[C_4mpy][NTf_2]$ ionic liquid to the main electroactive inorganic species that are present in the troposphere. The data is expressed as the ratio of the peak current change induced by 1% methane or 1% of the non-target gas.

Compared with 1% methane, the experimental results shown in FIG. 10 demonstrate no obvious increase of peak current in the air, indicating excellent selectivity (more than 100:1) of the analytical method under aerobic conditions.

No differences were observed for concentrations of carbon dioxide, as it was already in its fully oxidized state. There was no significant interference from $NO_2$ or $SO_2$, both of which are principle constituents of acid gas pollutants in the atmosphere. It was found that the presence of NO may have interfered with methane oxidation under atmospheric conditions, at least in part because there is oxidation of NO(NO to $NO^+$) at positive potentials in ionic liquids, and NO is easily oxidized to $NO_2$. Although it was difficult to observe clearly the oxidation peak of NO in the $[C_4mpy][NTf_2]$ system, the NO oxidation peak likely overlapped with the methane oxidation peak. However, it is believed that the influence of NO was decreased by the presence of oxygen. For NO, $NO_2$, and $SO_2$, typically the concentration in air is very low (i.e., a few ppm), and thus the interferences may be ignored.

Figure 11:
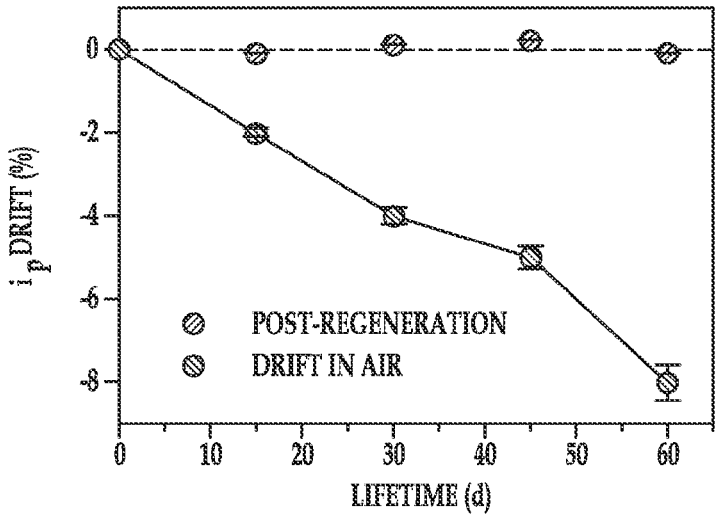
FIG. 11 is a graph illustrating the dependence of the 5 vol % methane over time.

The system with the $[C_4mpy][NTf_2]$ ionic liquid was shown to exhibit long-term stability. In FIG. 11, the peak current of the cyclic voltammetry measurement at 5% methane is plotted over the measurement period of 60 days. The signal drift is normalized to the first measurement of sensor response on the first day. The reported values are the result of averaging at least three measurements.

As shown in FIG. 11, there was 0.13%/day drift in the peak current. This was most likely due to electrode fouling with trace adsorption of other gases from the alkane and oxygen gas supplies (such as $CO_2$) at the active site of platinum so that the effective area was decreased. A platinum surface regeneration method (as described hereinabove) was used to remove any oxide film or undesired reaction products from the electrode surface. Compared with other electrolytes, the $[C_4mpy][NTf_2]$ ionic liquid is stable over a wide potential range and makes the regeneration possible in about 5 minutes. After platinum regeneration, an extremely small drift was observed (less than ±0.02 vol % over the entire 60 days measurement period).

Example 2

Oxidation of Pentane and Hexane

The system in this example was similar to the system in Example 1, except that a two air flow system was used to generate the different concentrations of pentane gas or hexane gas. Dry air was saturated with pentane or hexane by flowing the air through a wash bottle that contained the high purity liquid sample. This was then mixed with another dry air flow before purging the pentane or hexane vapor into the system.

The system including the $[C_4mpy][NTf_2]$ ionic liquid was exposed to cyclic voltammetry in air (i.e., 0% methane), and in one or more mixtures of air and pentane or hexane. The scan rate was 500 $mVs^{-1}$.

Figure 12A:
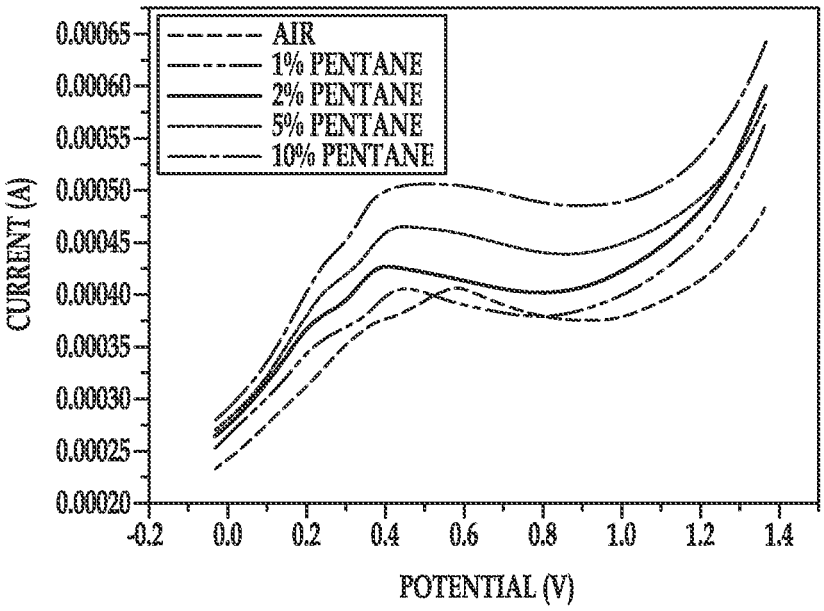
FIGS. 12A and 12B illustrate, respectively, anodic curves for different pentane concentrations exposed to the system including 1-butyl-1-methylpyrrolidinium bis(trifluoromethylsulfonyl)imide as the ionic liquid electrolyte, and the plot of peak current versus vol % pentane.
Figure 12B:
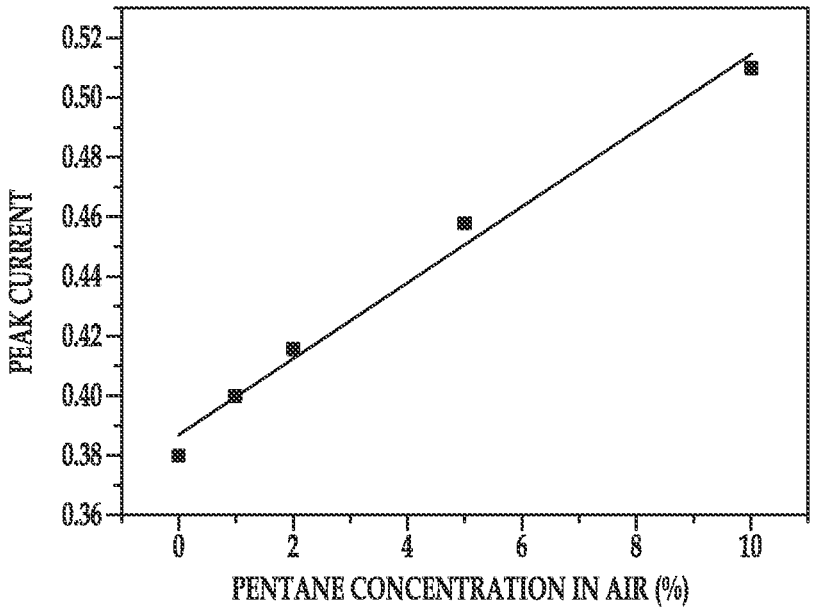
Figure 13A:
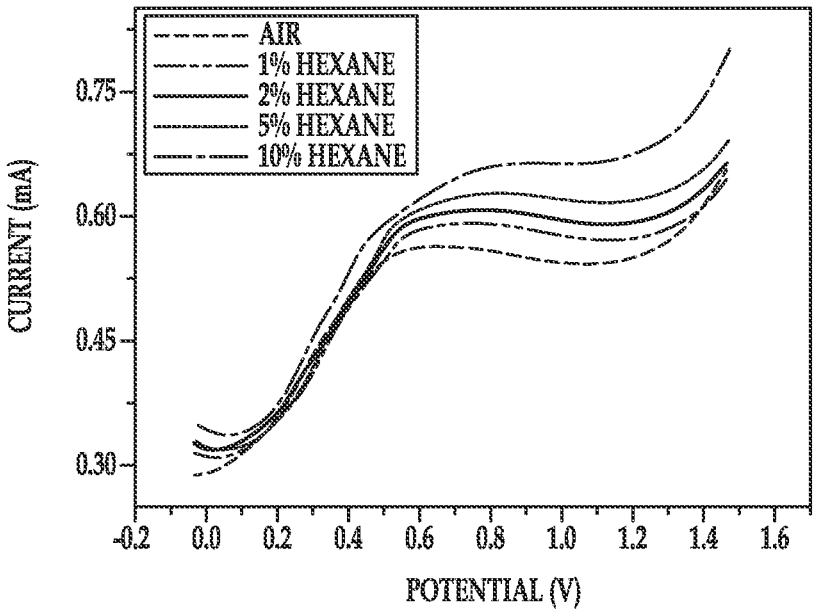
FIGS. 13A and 13B illustrate, respectively, anodic curves for different hexane concentrations exposed to the system including 1-butyl-1-methylpyrrolidinium bis(trifluoromethylsulfonyl)imide as the ionic liquid electrolyte, and the plot of peak current versus vol % hexane.
Figure 13B:
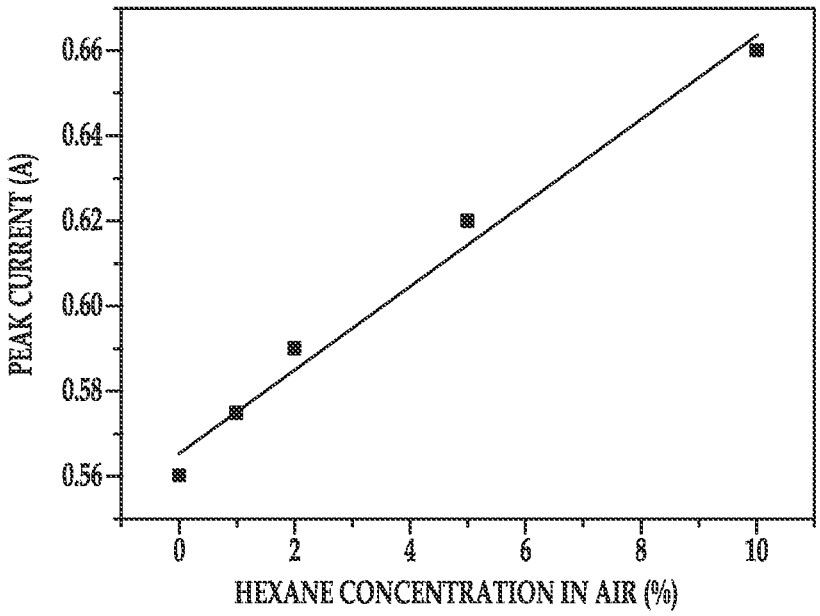

FIGS. 12A and 12B illustrate, respectively, the anodic curve for the different pentane concentrations and the plot of peak current versus vol % pentane. Similarly, FIGS. 13A and 13B illustrate, respectively, the anodic curve for the different hexane concentrations and the plot of peak current versus vol % hexane.

In these results, with an increase pentane or hexane concentration, the anodic current became larger than the air curve. It is believed that this is due to the oxidation of the pentane or hexane in the ionic liquid. The linear relationships exhibited in FIGS. 12B and 13B illustrates that these processes were also controlled by mass transfer.

Unlike methane, a higher anodic current at a potential over 1.2 V was observed at higher concentrations of hexane. It is believed that the new peak current is the result of further oxidation of the hexane to multiple products. Since one of the products of methane oxidation in the ionic liquid is carbon dioxide, which has a higher oxidation state of carbon, the anodic current decreased after potential scanned over 1.2 V in the presence of methane. For longer chain alkanes, however, it is believed that the alkane may be readily oxidized to other oxidation states, such as carboxylic acid and carbonyl compounds. The content of the final reaction products depends on, at least in part, the final potential and the alkane used. In some instances, the final reaction products may be a very complex mixture of multiple oxidation state species.

The methods disclosed herein rely upon the oxygen concentration, the platinum electrode potential, and the ionic liquid used. As illustrated by the results, each of these parameters may be selected in order to adequately and readily oxidize alkanes to reaction products that can be collected, measured, etc.

It is to be understood that the ranges provided herein include the stated range and any value or sub-range within the stated range. For example, a range from about 18° C. to about 30° C. should be interpreted to include not only the explicitly recited limits of about 18° C. to about 30° C., but also to include individual values, such as 20° C., 24.5° C., 27° C., etc., and sub-ranges, such as from about 20° C. to about 25° C., from about 19° C. to about 26° C., etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed:

1. An aerobic method for oxidizing an alkane, the method comprising:

generating a catalytic interface complex in situ at an interface between a platinum working electrode and an ionic liquid electrolyte by activating at least a portion of a surface of the platinum working electrode in the presence of the ionic liquid electrolyte, wherein the ionic liquid electrolyte is selected from the group consisting of 1 ethyl-1-methylpyrrolidinium bis(trifluoromethylsulfonyl)imide, 1-propyl-1-methylpyrrolidinium bis(trifluoromethylsulfonyl)imide, 1-butyl-1-methylpyrrolidinium bis(trifluoromethylsulfonyl)imide, 1-pentyl-1-methylpyrrolidinium bis(trifluoromethylsulfonyl)imide, 1-hexyl-1-methylpyrrolidinium bis(trifluoromethylsulfonyl)imide, 1-heptyl-1-methylpyrrolidinium bis(trifluoromethylsulfonyl)imide, 1-octyl-1-methylpyrrolidinium bis(trifluoromethylsulfonyl)imide, 1-nonyl-1-methylpyrrolidinium bis(trifluoromethylsulfonyl)imide, and 1-decyl-1-methylpyrrolidinium bis(trifluoromethylsulfonyl)imidem, and combinations thereof;

supplying an alkane gas to the interface, whereby the alkane adsorbs at or near the catalytic interface complex;

supplying the alkane gas in the presence of oxygen to the interface; and while the alkane gas in the presence of oxygen is supplied to the interface:

first applying a first electrode potential to the platinum working electrode; and then applying a positive electrode potential to the platinum working electrode, wherein the positive electrode potential is more positive than the first electrode potential, thereby causing a reactive oxygen species formed in situ at the interface to catalyze oxidation of the adsorbed alkane to form a reaction product.

2. The aerobic method as defined in claim 1 wherein the first electrode potential is less than about ±0.6 V, and the positive electrode potential is greater than ±0.7 V.

3. The aerobic method as defined in claim 1 wherein the supplying of the alkane gas to the interface is accomplished as no electrode potential is applied.

4. The aerobic method as defined in claim 1 wherein the activating of the at least the portion of the surface of the platinum working electrode includes performing multiple cycles of:

oxidizing the at least the portion of the surface of the platinum working electrode; and then exposing the platinum surface to a reduction process.

5. The aerobic method as defined in claim 4 wherein the oxidizing of the portion of the platinum working electrode surface is accomplished by:

supplying an oxygen-containing gas to the interface; and applying an initial electrode potential to the platinum working electrode.

6. The aerobic method as defined in claim 5 wherein the initial electrode potential is less positive than the positive electrode potential.

7. The aerobic method as defined in claim 5 wherein the oxygen-containing gas does not contain any alkane gas.

8. The aerobic method as defined in claim 1 wherein the supplying the alkane gas to the interface is accomplished by:

supplying the alkane gas in the presence of oxygen; and applying a negative electrode potential as another electrode potential.

9. The aerobic method as defined in claim 1 wherein:

the alkane is methane;

the alkane gas is methane gas; and the reaction product includes water and carbon dioxide.

10. The aerobic method as defined in claim 9 wherein an amount of the methane gas is 25% or less and the oxygen is supplied in air.

11. The aerobic method as defined in claim 1, further comprising purging the reaction product from the interface.

12. The aerobic method as defined in claim 11, further comprising:

performing a platinum surface regeneration method in the presence of nitrogen;

applying another electrode potential while supplying the alkane gas to the interface; and then repeating the applying of the positive electrode potential while supplying the alkane gas in the presence of oxygen.

13. The aerobic method as defined in claim 1 wherein the alkane gas is chosen from methane gas, pentane vapor, or hexane vapor.

14. The aerobic method as defined in claim 1, further comprising generating an alkane vapor from an alkane liquid to obtain the alkane gas.

15. The aerobic method as defined in claim 1 wherein the method is performed at a temperature ranging from about 18° C. to about 30° C.

16. The method as defined in claim 1 wherein the catalytic interface complex includes an anion from the ionic liquid, an oxygen that forms the reactive oxygen species, and platinum from the platinum working electrode.

17. The method as defined in claim 1 wherein the first electrode potential is −1.1 V or −1.2 V.

18. The method as defined in claim 1 wherein the first electrode potential ranges from −1.0 V to +0.6 V.

19. An aerobic method for oxidizing methane, the method comprising:

introducing 1-alkyl-1-methylpyrrolidinium bis(trifluoromethylsulfonyl)imide in contact with a platinum working electrode, wherein the alkyl is selected from the group consisting of ethyl, propyl, butyl, pentyl, hexyl, heptyl, octyl, nonyl, and decyl;

activating at least a portion of a surface of the platinum working electrode at an interface between the platinum working electrode and the 1-butyl-1-methylpyrrolidinium bis(trifluoromethylsulfonyl)imide, thereby forming a catalytic interface complex in situ at the interface;

supplying an oxygen-containing gas to the interface;

applying a negative electrode potential to the platinum working electrode while supplying the oxygen-containing gas;

supplying methane gas to the interface; and applying a positive electrode potential to the platinum working electrode while supplying the methane gas to allow catalyzed oxidation of the methane to form water and carbon dioxide in the presence of a reactive oxygen species formed in situ.

20. The method as defined in claim 19 wherein:

the negative potential ranges from −1.1 V to +0.6 V; and the positive electrode potential is greater than 0.7 V.

* * * * *